US008899374B2

(12) United States Patent
Tanaka et al.

(10) Patent No.: US 8,899,374 B2
(45) Date of Patent: Dec. 2, 2014

(54) SPEAKER UNIT AND SPEAKER UNIT MOUNTING STRUCTURE

(71) Applicant: Yamaha Corporation, Hamamatsu-shi, Shizuoka-ken (JP)

(72) Inventors: Katsuya Tanaka, Hamamatsu (JP); Kotaro Mizuno, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/913,330

(22) Filed: Jun. 7, 2013

(65) Prior Publication Data

US 2013/0327586 A1 Dec. 12, 2013

(30) Foreign Application Priority Data

Jun. 11, 2012 (JP) ..... 2012-132404

(51) Int. Cl.

| | |
|---|---|
| ***H04R 1/02*** | (2006.01) |
| ***B42F 13/02*** | (2006.01) |
| ***F21V 21/088*** | (2006.01) |
| *H04R 1/00* | (2006.01) |
| *B42F 13/00* | (2006.01) |
| *F21V 21/08* | (2006.01) |

(52) U.S. Cl.

CPC ..... *H04R 1/026* (2013.01); *H04R 2201/021* (2013.01)

USPC ..... 181/150; 381/395; 381/87; 248/343; 362/365; 362/371; 362/396

(58) Field of Classification Search

USPC ..... 181/199, 150, 153; 381/386, 395, 87; 248/343, 342, 344, 318, 320; 362/364, 362/365, 368, 371, 370, 396

See application file for complete search history.

(56) References Cited

U.S. PATENT DOCUMENTS

| | | | | | |
|---|---|---|---|---|---|
| 2,789,158 | A | * | 4/1957 | Livingston | 348/836 |
| 3,912,865 | A | | 10/1975 | Seebinger | |
| 4,048,491 | A | * | 9/1977 | Wessman | 362/364 |
| 4,673,149 | A | * | 6/1987 | Grote et al. | 248/343 |

(Continued)

FOREIGN PATENT DOCUMENTS

| | | | |
|---|---|---|---|
| DE | 3841861 | A1 | 7/1989 |
| DE | 4324057 | A1 | 1/1995 |
| JP | 2004-120192 | A | 4/2004 |
| JP | 2009-252604 | A | 10/2009 |

OTHER PUBLICATIONS

European Search Report mailed Oct. 1, 2013, for EP Application No. 13171252.3, seven pages.

*Primary Examiner* — Edgardo San Martin
(74) *Attorney, Agent, or Firm* — Morrison & Foerster LLP

(57) ABSTRACT

A speaker unit mounting structure includes a provisionally fastening mechanism for fastening a speaker unit to a ceiling with a cabinet section of the speaker unit inserted in a mounting hole of the ceiling. The provisionally fastening mechanism includes a provisionally fastening tab formed of resilient metal, fixed to the outer peripheral side surface of the cabinet section and having a stepped engaging section engageable with the inner peripheral edge portion of the mounting hole. Engagement of the engaging section with the inner peripheral edge portion of the mounting hole can be canceled by a human operator pressing, from the face side of the ceiling, an operating section of the tab, exposed to a gap between the front side and a flange portion of the speaker unit, to thereby resiliently deform the operating section.

9 Claims, 8 Drawing Sheets

(56) References Cited

U.S. PATENT DOCUMENTS

| | | | | | |
|---|---|---|---|---|---|
| 4,733,339 | A * | 3/1988 | Kelsall | 362/366 |
| 4,739,460 | A * | 4/1988 | Kelsall | 362/365 |
| 5,068,772 | A * | 11/1991 | Shapiro et al. | 362/365 |
| 5,077,650 | A * | 12/1991 | Cestari | 362/365 |
| 5,206,464 | A * | 4/1993 | Lamm et al. | 181/150 |
| 5,314,148 | A * | 5/1994 | Jones | 248/27.3 |
| 5,331,119 | A * | 7/1994 | Leger et al. | 181/150 |
| 5,567,041 | A * | 10/1996 | Slocum | 362/148 |
| 5,609,414 | A * | 3/1997 | Caluori | 362/366 |
| 5,931,432 | A * | 8/1999 | Herold et al. | 248/343 |
| 5,944,412 | A * | 8/1999 | Janos et al. | 362/365 |
| 5,964,523 | A * | 10/1999 | Eversberg | 362/365 |
| 6,554,458 | B1 * | 4/2003 | Benghozi | 362/365 |
| 6,588,922 | B1 * | 7/2003 | DeCicco | 362/364 |
| 6,827,471 | B1 * | 12/2004 | Benghozi | 362/365 |
| 6,870,943 | B2 * | 3/2005 | Liu | 381/395 |
| 6,896,394 | B2 * | 5/2005 | Houle | 362/365 |
| 7,401,681 | B2 * | 7/2008 | Iwayama et al. | 181/150 |
| 7,618,167 | B2 * | 11/2009 | Bedard | 362/366 |
| 7,731,130 | B2 * | 6/2010 | Decanio et al. | 248/27.3 |
| 7,780,135 | B2 * | 8/2010 | Nelson et al. | 248/342 |
| 7,909,487 | B1 * | 3/2011 | Venetucci et al. | 362/364 |
| 8,023,664 | B2 * | 9/2011 | Yang | 381/87 |
| 8,023,680 | B2 * | 9/2011 | Hayasaka et al. | 381/386 |
| 8,079,727 | B2 * | 12/2011 | Liang | 362/147 |
| 8,256,728 | B2 * | 9/2012 | Wright | 248/221.11 |
| 8,308,322 | B2 * | 11/2012 | Santiago et al. | 362/365 |
| 8,465,182 | B1 * | 6/2013 | Davis et al. | 362/364 |
| 8,474,774 | B2 * | 7/2013 | Svensson | 248/343 |
| 8,490,938 | B2 * | 7/2013 | Peng | 248/343 |
| 2007/0121988 | A1 * | 5/2007 | Merrey et al. | 381/386 |
| 2011/0110106 | A1 * | 5/2011 | Dupuy et al. | 362/368 |

* cited by examiner

SPEAKER UNIT AND SPEAKER UNIT MOUNTING STRUCTURE

BACKGROUND

The present invention relates to a speaker unit adapted to be embedded in an opening section formed in a mounting part, such as a ceiling or side wall, and also relates to a structure for installing or mounting the speaker unit by embedding it in the opening.

There have heretofore been known embedded-type speaker units (such as ceiling speakers) that are installed or mounted by being embedded in a mounting hole (opening section) formed in a ceiling or the like of a room, as disclosed for example in Japanese Patent Application Laid-open Publication No. 2004-120192 (hereinafter referred to as "the relevant patent literature"). Generally, such a speaker unit includes a cabinet section of a substantially cylindrical shape, and a speaker face provided on the bottom surface of the cabinet section. To mount the speaker unit, the cabinet section is inserted into a mounting hole of the ceiling with the speaker face exposed on the face (i.e., lower surface) of the ceiling, and then the inserted cabinet section is fixed or fastened to the ceiling by fastening via bolts or the like. A mounting structure for such a speaker unit includes a provisionally fastening structure for preventing the heavy speaker unit from falling down by mistake before the fastening via the bolts or the like or after cancellation of the fastening, as disclosed in the relevant patent literature.

The provisionally fastening structure disclosed in the relevant patent literature is constructed in such a manner that, with the cabinet section (speaker housing) inserted in the mounting hole of the ceiling, opposite end portions of a resilient member (provisional fixation member), fixed or fastened to an upper wall of the speaker housing and extending in a reverse side region of the ceiling, abuts against a portion of the reverse side surface of the ceiling adjacent to the outer periphery of the mounting hole. By the abutment, against the reverse side of the ceiling, of the resilient piece, the speaker unit is provisionally fastened in such a manner as to not fall down from the mounting hole.

However, with the provisionally fastening structure disclosed in the relevant patent literature, once the speaker unit is provisionally fastened with the end portions of the resilient piece abutted against the reverse side of the ceiling around the outer periphery of the mounting hole, the abutting engagement of the resilient piece with the ceiling cannot be canceled by only an ordinary operation performed by a speaker-mounting human operator from the face side (lower side) of the ceiling, and thus, the provisionally fastened speaker unit cannot be readily pulled out from the mounting hole of the ceiling. Thus, when the provisionally fastened speaker unit is to be detached for some reason in a speaker unit mounting operation, or when the speaker unit placed in the provisionally fastened position or state after having been released from the fully fixed or fastened state is to be pulled out of the mounting hole of the ceiling in a speaker unit dismounting operation, a disadvantage of poor operability would be encountered.

SUMMARY OF THE INVENTION

In view of the foregoing prior art problems, it is an object of the present invention to provide an improved speaker unit and an improved speaker unit mounting structure which, with a simple construction of a minimized number of necessary component parts, allows the speaker unit to be released from a provisionally fastened state through only a simple operation performed from the face side of a mounting part.

Note that the same reference numerals and characters as used for various constituent elements of later-described embodiments of the present invention are indicated in parentheses here for ease of understanding.

In order to accomplish the above-mentioned object, the present invention provides an improved speaker unit (1) adapted to be mounted in an opening section (61) formed in a mounting part (60), the speaker unit (1) comprising: a cabinet section (2) having an outer peripheral side surface (2*c*) and a bottom surface (2*a*); a speaker face (4) provided on the bottom surface (2*a*) of the cabinet section (2); and a provisionally fastening mechanism (10) provided on the outer peripheral side surface (2*c*) of the cabinet section (2) and adapted to provisionally fasten the speaker unit (1) with at least a part of the cabinet section (2) inserted in the opening section (61) from a face side (60*a*) of the mounting part (60), said provisionally fastening mechanism (10) comprising: an engaging section (13) adapted to make the speaker unit (1) provisionally engage the mounting part (60); and an operating section (15) exposed to the face side of the mounting part (60) with the speaker unit (1) engaged the mounting part (60) via the engaging section (13), said operating section (15) adapted to cancel engagement between the speaker unit (1) and the mounting part (60) via said engaging section (13) in response to an operation of a portion of the operating section (15) where the operating section (15) is exposed.

In order to accomplish the above-mentioned object, the present invention provides an improved speaker unit mounting structure for mounting a speaker unit (1) in an opening section (61) formed in a mounting part (60), the speaker unit (1) including a cabinet section (2) having an outer peripheral side surface (2*c*) and a bottom surface (2*a*), and a speaker face (4) provided on the bottom surface (2*a*) of the cabinet section (1), the speaker unit mounting structure comprising a provisionally fastening mechanism (10) constructed to provisionally fasten the speaker unit (1) with at least a part of the cabinet section (2) inserted in the opening section (60) from a face side of the mounting part (60), the provisionally fastening mechanism (10) including a provisionally fastening member (11) formed of a resilient material and fixed to the outer peripheral side surface (2*c*) of the cabinet section (2), the provisionally fastening member (11) including: an engaging section (13) engageable with an inner peripheral edge portion (61*a*) of the opening section (60) on a reverse side of the mounting part (60) to thereby place the speaker unit (1) in a provisionally fastened state; and an operating section (15) exposed to the face side of the mounting part (60) through a gap (X, 7*a*) between the opening section (61) and the cabinet section (2). In response to the operating section (15) being operated from the face side of the mounting part (60), the provisionally fastening member (11) resiliently deforms so that engagement of the engaging section (13) with the inner peripheral edge portion (61*a*) of the opening section (61) is canceled, i.e. the engaging section (13) is released from the engagement with the inner peripheral edge portion (61*a*) of the opening section (61).

According to the speaker unit mounting structure of the present invention, the provisional fastening, by the provisionally fastening mechanism, of the speaker unit can be readily canceled by to a human operator merely operating, from the face side of the mounting part, such as a ceiling or side wall, the operating section to thereby resiliently deform the engaging section out of the engagement with the inner peripheral edge portion of the opening section. Thus, in the speaker unit mounting or dismounting operation, the speaker unit, placed in the provisionally fastened state or position by the provisionally fastening member, can be released from the provisionally fastened state through a simple operation (e.g., manual operation). In this way, the present invention can enhance operability when the provisionally fastened speaker unit is to be dismounted for some reason in the speaker unit mounting operation, or when the speaker unit placed in the provisionally fastened state after having been released from a fully fixed or fastened state is to be pulled out of the opening section in the speaker unit dismounting operation.

Preferably, in an embodiment, the speaker unit mounting structure of the present invention further comprises a flange portion (5) projecting radially outward (i.e., outward in a radial direction from the center axis of the cabinet section (2)) from the outer peripheral edge of the bottom surface (2*a*) of the cabinet section (2), and, with the speaker unit (2) in the provisionally fastened state, the gap (X) is defined between a face side surface (60*a*) of the mounting part (60) and the flange portion (5). Thus, in response to the operating section (15) being operated with a finger through the gap (X), the provisionally fastening member (11) resiliently deforms so that engagement of the engaging section (13) with the inner peripheral edge portion (61*a*) of the opening section (61) is canceled. Because the gap is defined between the face side surface of the mounting part and the flange portion when the speaker unit is in the provisionally fastened state, the human operator can operate the provisionally fastening member, from the face side of the mounting part, with a finger of its (i.e., his or her) hand using the gap. Thus, the provisional fastening of the speaker unit can be readily canceled with a simple construction and through only a simple manual operation performed from the face side of the mounting part. Further, such arrangements allow the human operator to operate the operating section by inserting the finger into the gap while supporting the bottom surface of the speaker unit with the palm of its hand. Because the human operator can release the provisionally fastening member from the engagement with the inner peripheral edge portion of the opening section while reliably supporting the heavy speaker unit with the hand, cancellation of the provisional fastening of the speaker unit can be effected safely and promptly Preferably, in an embodiment, the provisionally fastening member (11) integrally has: a mounting section (12) fixed to the outer peripheral side surface (2*c*) of the cabinet section (2); a slanting section (14) extending obliquely downward from the mounting section (12) toward the radially outward end of the cabinet section (2) and toward the bottom surface (2*a*); the engaging section (13) extending radially inward from the distal end of the slanting section (14); and the operating section (15) extending from the distal end of the engaging section (13) toward the bottom surface (2*a*) of the cabinet section (2). Because the provisionally fastening member, integrally has the mounting section, slanting section, engaging section and operating section, the engaging section can be readily released from the engagement with the inner peripheral edge portion of the opening section by the human operator depressing, from the face side of the mounting part, the operating section to resiliently deform the operating section in the provisionally fastened state of the speaker unit where the engaging section is held in engagement with the inner peripheral edge portion of the opening section. Thus, even though the provisionally fastening mechanism in the embodiment is of a simple construction comprising a minimized number of necessary component part, i.e. comprising only the provisionally fastening member, the provisional fastening of the speaker unit can be canceled with only a simple pressing operation (e.g., manual operation) performed from the face side of the mounting part. Further, the provisionally fastening member (11) has the slanting section (14) obliquely extending from the mounting section (12) radially outward of the cabinet section and toward the bottom surface as noted above, and thus, as the cabinet section is inserted into the opening section, the sliding section abuttingly slides across the inner peripheral edge portion of the mounting part until the engaging section gets over the inner peripheral edge portion to come into engagement with the inner peripheral edge portion. Thus, the engaging section is allowed to engage with the inner peripheral edge portion by the human operator only inserting the cabinet section into the opening section. In this way, the present invention permits the provisional fastening of the speaker unit with only the simple operation of inserting the cabinet section into the opening section of the mounting part and without requiring any tool and the like.

Preferably, in an embodiment, the provisionally fastening member (11) is constructed in such a manner that the engagement of the engaging section (13) with the inner peripheral edge portion (61*a*) of the opening section (61) is canceled in response to the operating section (15) being pressed, and the operating section (15) is disposed with an interval (Y) from the outer peripheral side surface (2*c*) of the cabinet section (2). Such arrangements allow the provisionally fastening member to be resiliently deformed toward the cabinet section by the human operator pressing the operating section, from the face side of the mounting part, in the provisionally fastened state where the engaging section is held in engagement with the inner peripheral edge portion of the opening section and thereby moving the operating section over a distance corresponding to a dimension of the interval. Thus, the engaging section can be readily released from the engagement with the inner peripheral edge portion of the opening section. In this way, the provisional fastening of the speaker unit can be canceled with a simple construction and through only a simple pressing operation (e.g., manual operation) performed from the face side of the mounting part.

Preferably, in an embodiment, the speaker unit mounting structure of the present invention further comprises a bottom cover (7) that surrounds the bottom surface (2*a*) of the cabinet section (2) and an outer periphery of the cabinet section (2) adjoining the bottom surface (2*a*) and that has an outer peripheral edge (7*c*) disposed along the inner peripheral edge portion (61*a*) of the opening section (61), and the bottom cover (7) has a hollow portion (7*a*) formed therein with the interval (Y) left between the operating section (15) and the inner surface of the hollow portion (71). Because the hollow portion is formed in the bottom cover, the operating section of the provisionally fastening member can be exposed, through the hollow portion, to the face side of the mounting part in the provisionally fastened state where the speaker unit has been provisionally fastened in the opening section by the provisionally fastening mechanism. Thus, in the provisionally fastened state, the operation for pressing the provisionally fastening member can be performed reliably from the face side of the mounting part. Besides, because the provision of the hollow portion can secure an appropriate movable space for the provisionally fastening member, the engaging section can be reliably released from the engagement with the inner peripheral edge portion of the opening section by the provisionally fastening member being pressed from the face side.

Preferably, in an embodiment, the speaker unit mounting structure further comprises a fixation mechanism (30) for fully fastening the speaker unit (1) provisionally fastened in the opening section (61) by the provisionally fastening mechanism (10), and the fixation mechanism (30) includes a fixation member (31) provided for movement alongside of the cabinet section (2) and constructed to sandwich the inner peripheral edge portion (61*a*) of the opening section (61) between the flange portion (5) and the fixation member (31) to thereby fix the speaker unit (1). By the provision of the fixation mechanism, the speaker unit provisionally fastened by the provisionally fastening mechanism can be fully fastened.

Preferably, in an embodiment, the outer peripheral side surface (2*c*) of the cabinet section (2) comprises a plurality of flat surfaces (6), and at least a set of the provisionally fastening mechanism (10) and the fixation mechanism (30) is disposed in association with each individual one of the plurality of flat surfaces (6) of the outer peripheral side surface (2*c*). In this case, the plurality of surfaces (6) are oriented in a plurality of different directions on the outer peripheral side surface (2*c*) of the cabinet section (2) of a generally cylindrical (circular or polygonal cylindrical) shape. Because at least one set of the provisionally fastening mechanism and the fixation mechanism is disposed on, or within the range of, one of the surfaces that is oriented in one direction on the outer peripheral side surface (2*c*), a provisionally fastened position of the speaker unit and a fully fastened position of the speaker unit can be located along the same radial direction from the center axis, i.e. located on the same radial side, of the speaker unit in the speaker unit mounting operation. Because the provisionally fastened position of the speaker unit and the fully fastened position of the speaker unit can be located along the same radial direction, the speaker unit mounting operation can be performed with an increased efficiency.

Preferably, in an embodiment, the speaker unit (1) includes a plurality of sets of the provisionally fastening mechanisms (10) and the fixation mechanisms (30). Because a plurality of sets of the provisionally fastening mechanisms and the fixation mechanisms are provided on the speaker unit, the provisional fastening and the full fastening of the speaker unit is performed at a plurality of positions. In this way, the present invention permits stabilization of the provisional fastening and the full fastening of the speaker unit.

The speaker unit mounting structure of the present invention allows the speaker unit to be released from the provisionally fastened state with a simple construction of a minimized number of necessary component parts and through only a simple operation performed from the face side of a mounting part.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which:

FIGS. 5A to 5C are schematic perspective views explanatory of a construction and behavior of a stopper mechanism in the embodiment, of which FIG. 5A shows the stopper piece in an initial position, FIG. 5B shows the stopper piece having pivoted from the initial position and FIG. 5C shows the stopper piece in a fixed position;

DETAILED DESCRIPTION

Figure 1:
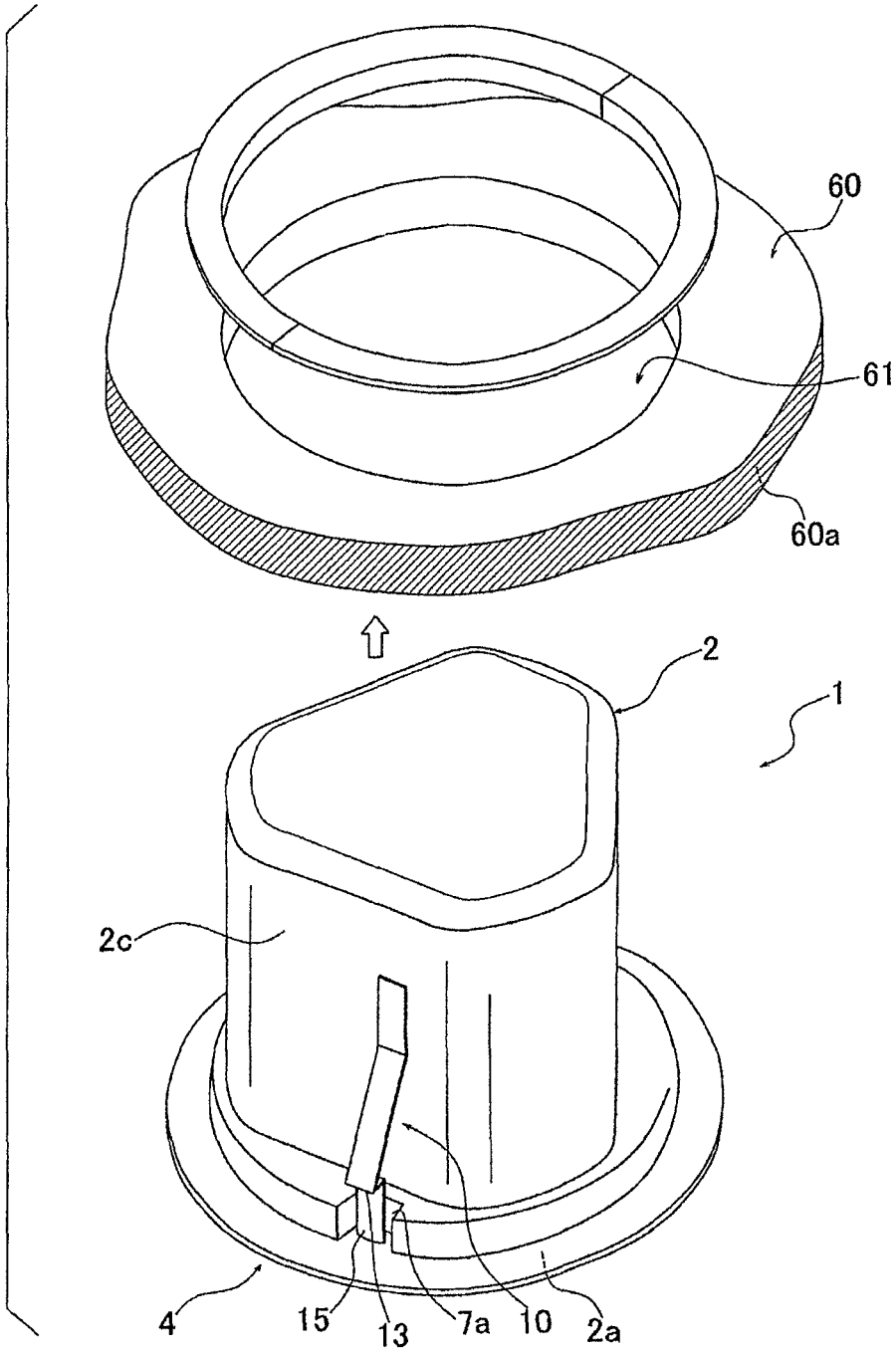
FIG. 1 is a perspective view schematically showing a preferred embodiment of a speaker unit according to the present invention along with an embodiment of a mounting hole in which the speaker unit is to be mounted.

The following describe preferred embodiments of the present invention with reference to the accompanying drawings. FIG. 1 is a perspective view schematically showing a preferred embodiment of a speaker unit according to the present invention along with an embodiment of a mounting hole in which the speaker unit is to be mounted. A speaker unit 1 has a construction suitable to be mounted in an opening section 61 formed in a mounting part 60 such as a ceiling. The speaker unit 1 comprises: a cabinet section 2 having an outer peripheral side surface 2*c* and a bottom surface 2*a*; and a speaker face 4 provided on the bottom surface 2*a* of the cabinet section 2. The speaker unit 1 further comprises a provisionally fastening mechanism 10 which is provided on the outer peripheral side surface 2*c* of the cabinet section 2 and adapted to provisionally fasten the speaker unit 1 with at least a part of the cabinet section 2 inserted in the opening section 61 from a face side 60*a* of the mounting part 60 (e.g., ceiling). The provisionally fastening mechanism 10 comprises an engaging section 13 and an operating section 15. The engaging section 13 is configured to make the speaker unit 1 provisionally engage the mounting part 60. The operating section 15 is configured to be exposed to the face side of the mounting part 60 with the speaker unit 1 engaged the mounting part 60 via the engaging section 13. The operating section 15 is adapted to cancel engagement between the speaker unit 1 and the mounting part 60 via the engaging section 13 in response to an operation of a portion (i.e., user's operation to the portion) of the operating section 15 where the operating section 15 is exposed. In this way, the speaker unit 1 can be released from the provisionally fastened state with a simple construction of a minimized number of necessary component parts and through only a simple operation performed from the face side of the mounting part 60.

Figure 2:
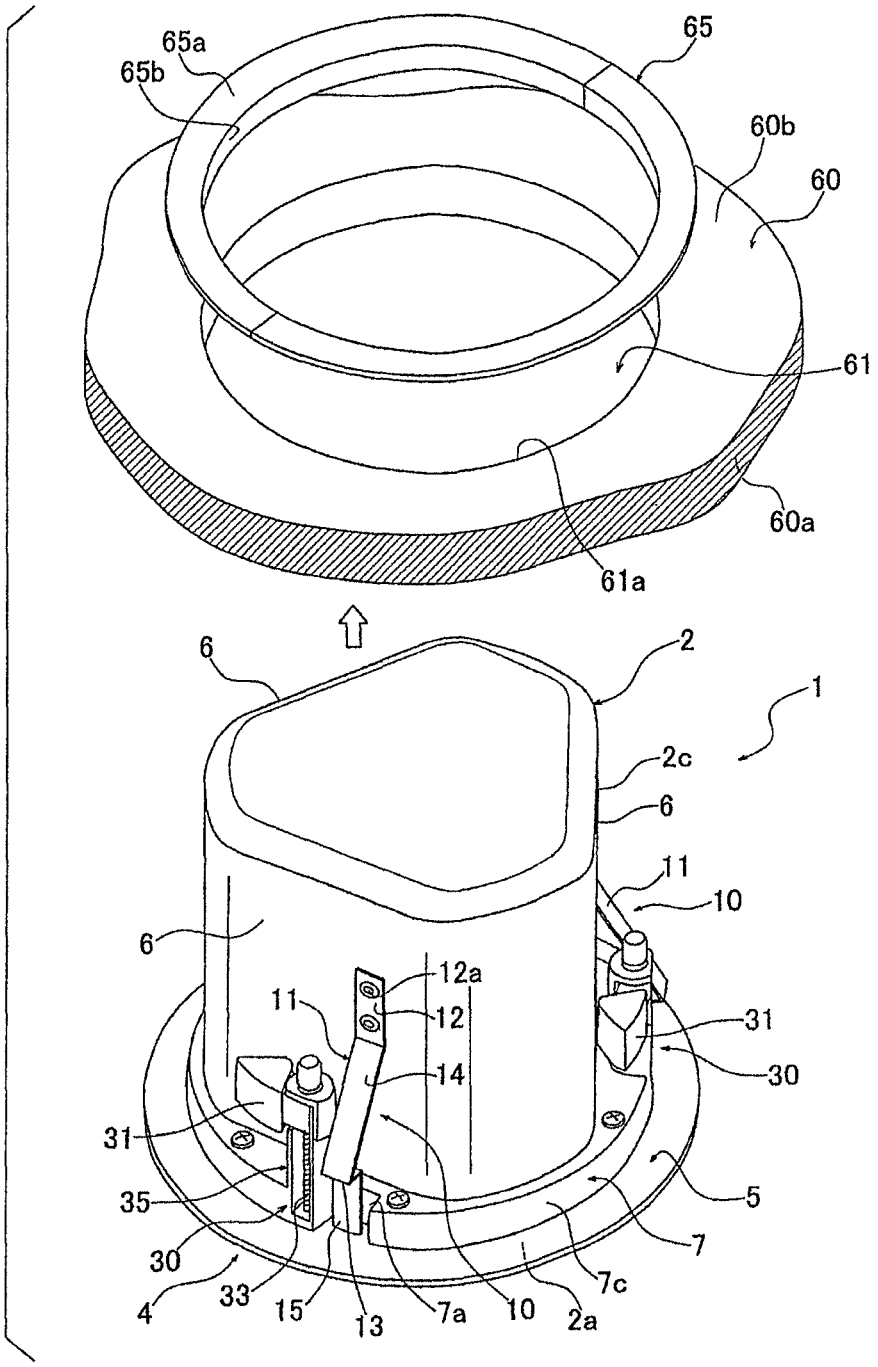
FIG. 2 is a perspective view showing a speaker unit employing a preferred embodiment of a speaker unit mounting structure of the present invention and a mounting hole in which the speaker unit is to be mounted.
Figure 3:
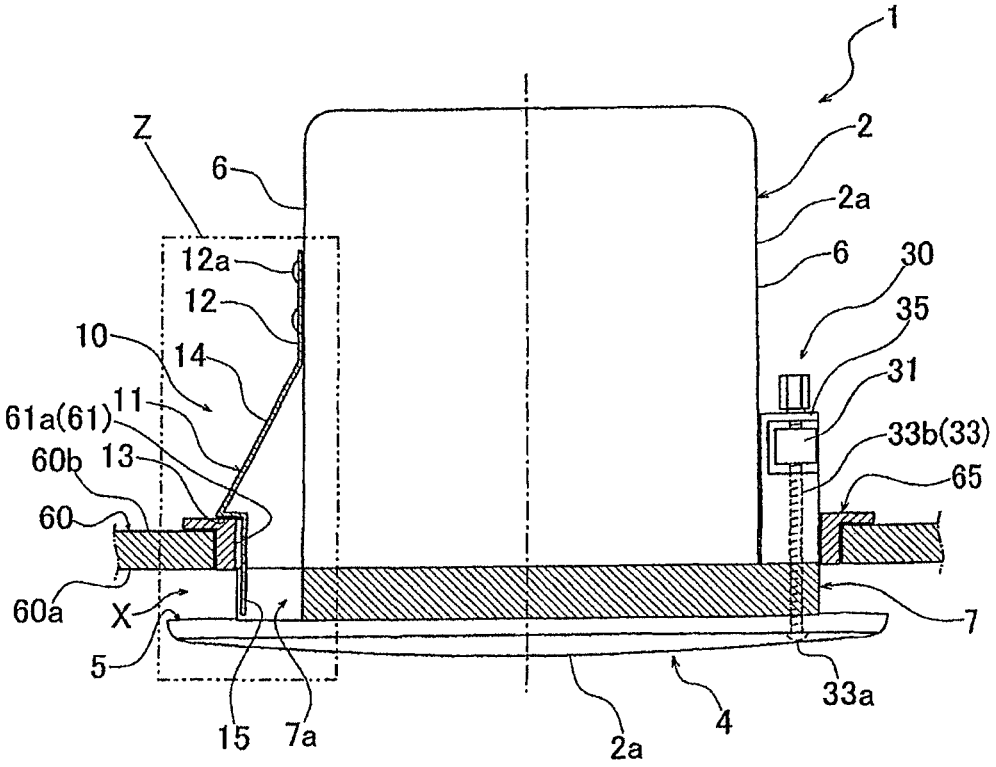
FIG. 3 is a partly sectional side view showing the speaker unit provisionally fastened in the mounting hole (opening section) of a ceiling.

Further, a more detailed embodiment of the present invention will be described hereinafter with reference to FIGS. 2-8D. FIG. 2 is a perspective view of a speaker unit 1 employing a preferred embodiment of a mounting structure of the present invention, and FIG. 3 is a partly sectional side view showing the speaker unit 1 provisionally fastened to a mounting hole (i.e., opening section) 61 of a ceiling (i.e., mounting part) 60. Note that, in FIG. 3, an area of the speaker unit 1 to the left of the centerline of the speaker unit 1 represents a vertical section taken through a portion of a later-described provisionally fastening mechanism 10 while an area of the speaker unit 1 to the right of the centerline of the speaker unit 1 represents a vertical section taken through a portion of a later-described stopper mechanism (i.e., fixation mechanism) 30. As shown in FIG. 2, the speaker unit 1 is an embedded-type speaker unit (or ceiling speaker) installed or mounted by being embedded in the mounting hole (opening section) 61 formed in the ceiling (mounting part) 60 of a room.

The mounting hole 61 of the ceiling 60 shown in FIGS. 2 and 3 is a circular through-hole formed through the ceiling 60, namely, from the face side surface (i.e., lower side surface) 60*a* to the reverse side surface (i.e., upper side surface) 60*b* of the ceiling 60. A mounting hardware member 65, which is an annular, thin plate-shaped member, is provided on and along the inner peripheral edge portion 61*a* of the mounting hole 61. The mounting hardware member 65, which has a generally L sectional shape, has an upper wall 65*a* placed on the upper surface of the inner peripheral edge portion 61*a* of the mounting hole 61 and a peripheral side wall 65*b* placed on the inner peripheral surface of the inner peripheral edge portion 61*a* of the mounting hole 61. The mounting hardware member 65 is mounted by being placed, from the reverse side of the mounting hole 61, on the inner peripheral edge portion 61*a* of the mounting hole 61. Note that, in the following description, the term "inner peripheral edge portion 61*a* of the mounting hole 61" is used to refer to the inner peripheral edge portion of the mounting hole 61 with the mounting hardware member 65 mounted thereon.

The speaker unit 1 includes a cabinet section 2 of a substantially cylindrical shape configured to be fastened in the mounting hole 61 of the ceiling 60, and a speaker face (i.e., speaker's sounding front surface) 4*a* provided on the bottom surface 2*a* of the cabinet section 2. In FIG. 3 etc., only the outline of the cabinet section 2 is illustrated with illustration of an inner construction of the cabinet section 2 omitted. Further, in the following description, terms "upper" and "lower" are used to refer to an axial direction (up-down direction in FIG. 2) of the cylindrical cabinet section 2. A bottom cover 7 is provided to surround the bottom surface 2*a* of the cabinet section 2 and the outer periphery of the cabinet section 2 adjoining the bottom surface 2*a*. The bottom cover 7 is an annular or ring-shaped member covering the bottom surface 2*a* of the cabinet section 2 and a part of the outer periphery of the cabinet section 2 immediately above the bottom surface 2*a*, and the outer peripheral surface (outer peripheral edge) 7*c* of the cover 7 has a diameter slightly smaller than a diameter of the inner peripheral edge portion 61*a* of the mounting hole 61 but greater than an outer diameter of the upper end of the cabinet section 2. Thus, the bottom cover 7 is formed as an annular or ring-shaped protrusion projecting radially outward (i.e., outward in a radial direction from the center axis of the cabinet section 2) from the bottom surface 2*a* and the part of the outer periphery of the cabinet section 2 adjoining the bottom surface 2*a*. Further, the bottom cover 7 is formed in such a manner that, with the speaker unit 1 installed or mounted in the mounting hole 61*a*, the outer peripheral surface 7*c* is opposed to the inner peripheral edge portion 61*a* of the mounting hole 61 with a slight gap therebetween. In the instant embodiment, the bottom cover 7 is a member formed of synthetic resin, and the cabinet member 2 located upwardly of the bottom cover 7 is a member formed of metal. Further, the outer peripheral surface 7*c* of the bottom cover 7 has a hollow portion 7*a* formed therein for accommodating therein an operating section 15 of a later-described provisionally fastening tab 11. The hollow portion 7*a* is in the form of a hollow (cavity) formed by recessing the outer peripheral surface 7*c* of the bottom cover 7 in a substantially rectangular shape as viewed in plan.

Further, a thin plate-shaped flange portion 5 projecting radially outward is formed on the lower-end outer periphery of the bottom cover 7. More specifically, the flange portion 5 is formed as a ring-shaped edge portion formed integrally with the bottom cover 7 to extend radially outward at generally the same height position as the bottom surface 2*a* of the cabinet section 2 (speaker face 4).

Figure 4:
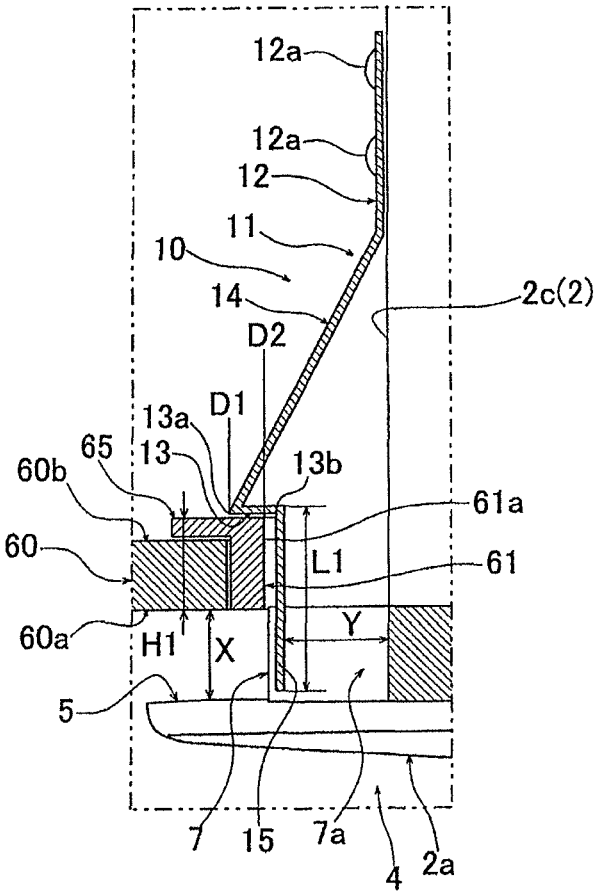
FIG. 4 is a fragmentary enlarged view of a section Z shown in FIG. 3, which particularly shows detailed constructions of a provisionally fastening tab and other components around the provisionally fastening tab.

The speaker unit 1 further includes the provisionally fastening mechanism 10 for provisionally fastening to the ceiling 60 the speaker unit 1 with the cabinet section 2 inserted through the mounting hole 61. The provisionally fastening mechanism 10 includes a provisionally fastening tab (provisionally fastening member) 11 fixed at one end portion to the outer peripheral side surface 2*c* of the cabinet section 2. FIG. 4 is a fragmentary enlarged view of a section Z shown in FIG. 3, which particularly shows detailed constructions of the provisionally fastening tab 11 and other components around the provisionally fastening tab 11. The provisionally fastening tab 11, which is in the form of a thin plate of resilient metal, integrally has: a mounting section 12 fixed or fastened to the outer peripheral side surface 2*c* of the cabinet section 2 by means of screws 12*a*; a stepped engaging section 13 engageable with the inner peripheral edge portion 61*a* of the mounting hole 61 on the reverse side of the ceiling 60; a slanting section 14 extending obliquely downward from the mounting section 12 toward the radially outward end of the cabinet section 2 and toward the bottom surface 2*a* and connecting to the outward lower end 13*a* of the engaging section 13; an operating section 15 extending vertically from the inner lower end 13*b* of the engaging section 13 toward the bottom surface 2*a* of the cabinet section 2.

The following describe positions and dimensions of the individual sections of the provisionally fastening tab 11. As shown in FIG. 4, the operating section 15 is positioned in the hollow portion 7*a* with the mounting section 12 fixed to the outer peripheral side surface 2*c* of the cabinet section 2. In this state, the operating section 15 is positioned in the hollow portion 7*a* with an interval Y left between the operating section 15 and the radially inner surface (bottom surface) of the hollow portion 7*a* (i.e., outer peripheral side surface 2*c* of the cabinet section 2). Further, with the cabinet section 2 installed in the mounting hole 61, the position D1 of the outward lower end 13*a* of the engaging section 13 of the provisionally fastening tab 11 is normally located radially outward of the position D2 of the inner peripheral edge portion 61*a* of the mounting hole 61. However, with the operating section 15 pressed to be evacuated deeper into the hollow portion 7*a* (see FIG. 7B), the outward lower end 13*a* of the engaging section 13 is located radially inward of the inner peripheral edge portion 61*a* of the mounting hole 61.

Further, the operating section 15 of the provisionally fastening tab 11 has a length dimension L1 greater than a thickness dimension H1 of the ceiling 60 (i.e., L1>H1). Thus, with the engaging section 13 of the provisionally fastening tab 11 abuttingly engaging with the inner peripheral edge portion 61*a* of the mounting hole 61, the operating section 15 projects downward beyond the face side (surface) 60*a* of the ceiling 60. The operating section 15 projecting downward beyond the face side surface 60*a* of the ceiling 60 is located facing a gap X defined between the face side surface 60*a* of the ceiling 60 and the flange portion 5.

Further, as shown in FIGS. 2 and 3, the speaker unit 1 also includes the stopper mechanism (fixation mechanism) 30 for fully fixing or fastening the speaker unit 1 provisionally fastened in the mounting hole 61 by means of the provisionally fastening mechanism 10. The stopper mechanism (fixation mechanism) 30 includes a stopper piece (fixation member) 31 provided for movement in the vertical or up-down direction alongside of the cabinet section 2, so that the stopper mechanism (fixation mechanism) 30 can fasten the speaker unit 1 by sandwiching the inner peripheral edge portion 61*a* between the flange portion 5 and the stopper piece (fixation member) 31.

Figure 5A:
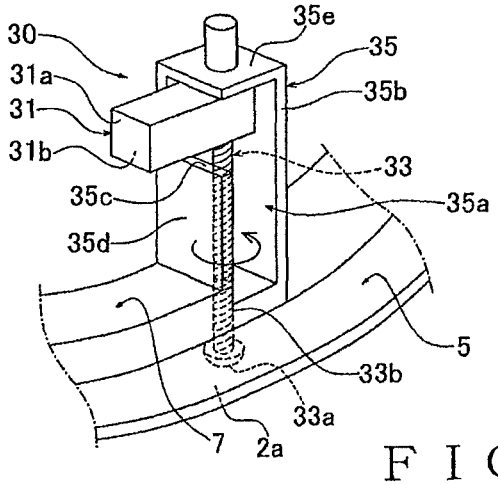
Figure 5B:
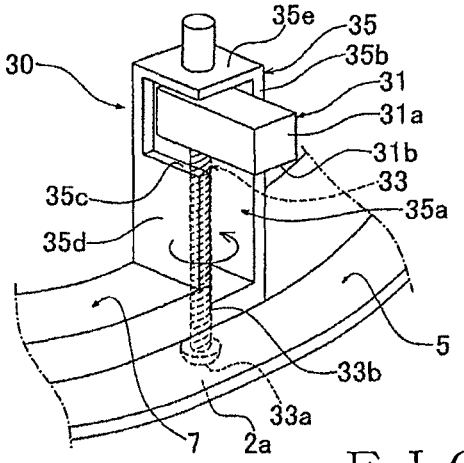
Figure 5C:
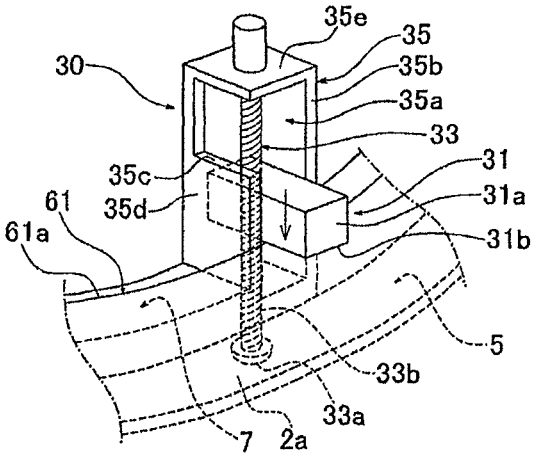

FIGS. 5A to 5C are schematic perspective views explanatory of a construction and behavior of the stopper mechanism (fixation mechanism) 30, of which FIG. 5A shows the stopper piece 31 in a later-described initial position, FIG. 5B shows the stopper piece 31 having pivoted from the initial position and FIG. 5C shows the stopper piece 31 in a later-described fixed position. The stopper mechanism 30 includes a frame section 35 rotatably supporting a screw shaft 33, and the stopper piece 31 threadedly engaging the screw shaft 33 and partly accommodated within the frame section 35. Note that FIGS. 5A to 5C show the shape of the stopper piece 31 in a simplified fashion as compared to that shown in FIG. 2. As shown in FIGS. 5A to 5C, the screw shaft 33 includes a head portion 33*a* exposed from the bottom surface 2*a* (speaker face 4) of the speaker unit 1, and a shaft portion 33*b* extending from the head portion 33*a*, through the bottom cover 7 and interior space of the frame section 35, to an upper wall 35*e* of the frame section 35 in the axial direction (vertical or up-down direction) of the cabinet section 2. A screw groove is formed in the outer peripheral surface of the shaft portion 33*b*. The shaft portion 33*b* is rotatably mounted at its upper end to the upper wall 35*e* of the frame section 35. The screw shaft 33 is rotatable about its axis in the interior space of the frame section 35 by a human operator rotating, from the side of the bottom surface 2*a* of the speaker unit 1, the head portion 33*a* by means of a not-shown tool, such as a screw driver. Further, a proximal end portion of the stopper piece 31 is in threaded engagement with the screw shaft 33 so that the stopper piece 31 is rotatable integrally with the screw shaft 33 in a plane parallel to the ceiling 60 and also movable relative to the screw shaft 33 in the vertical direction as the screw shaft 33 is rotated relative to the stopper piece 31. More specifically, the stopper piece 31 is vertically movable between a slit-shaped opening 35*a*, formed in the front surface of the frame section 35 and extending in the vertical direction, and a recessed portion 35*c* formed in a side wall 35*b* of the frame section 35.

In the stopper mechanism 30 constructed in the aforementioned manner, counterclockwise rotation of the screw shaft 33 when the stopper piece 31 is located at the uppermost end in the opening 35*a* causes the stopper piece 31 to pivot in the counterclockwise direction to be positioned in the recessed portion 35*c* as shown in FIG. 5A. The position of the stopper mechanism 30 shown in FIG. 5A is referred to as "initial position". As the head portion 33*a* of the screw shaft 33 is rotated in the clockwise direction from the side of the bottom surface 2*a* of the speaker unit 1 by means of a tool, such as a screw driver, the stopper piece 31 threadedly engaging the screw shaft 33 pivots in the clockwise direction. Then, as shown in FIG. 5B, at a position where the stopper piece 31 has pivoted through 90° from the initial position, the stopper piece 31 abuts against the side wall 35*b* of the frame section 35 and thus is prevented from pivoting further. Then, as the screw shaft 33 is rotated further in the clockwise direction, the stopper piece 31 moves in the opening 35*a* downward toward the bottom cover 7 until the lower surface 31*b* of the stopper piece 31 abuts against the inner peripheral edge portion 61*a* of the mounting hole 61 (reverse side surface 60*b* of the ceiling 60).

Then, as the stopper piece 31 is caused to move further downward relative to the screw shaft 33, a position of the speaker unit 1 in the mounting hole 61 gradually moves upward, or ascends, relative to the ceiling 60. Ultimately, the inner peripheral edge portion 61*a* of the mounting hole 61 is sandwiched between the lower surface 31*b* of the stopper piece 31 and the flange portion 5, so that the speaker unit 1 is fully fixed or fastened in the mounting hole 61. The position of the stopper mechanism 30 when the speaker unit 1 is ultimately fastened in the mounting hole 61 will hereinafter be referred to "fixed position".

To cancel the fixation (full fastening), by the stopper mechanism 30, of the speaker unit 1, the screw shaft 33 is rotated in the counterclockwise direction while the stopper mechanism 30 is in the aforementioned fixed position. Thus, the stopper piece 31 moves upward, or ascends, relative to the screw shaft 33, so that the sandwiching engagement, by the stopper piece 31 and the flange portion 5, of the inner peripheral edge portion 61*a* of the mounting hole 61 is canceled. Further, in response to the screw shaft 33 being rotated in the clockwise direction, the stopper piece 31 moves upward or ascends, so that the speaker unit 1 gradually moves downward or descends in the mounting hole 61. Ultimately, the downward movement of the speaker unit 1 is stopped at the position where the engaging section 13 of the provisionally fastening tab 11 abuts against the reverse side surface 60*b* of the ceiling 60 (inner peripheral edge portion 61*a* of the mounting hole 61). Then, as the screw shaft 33 is rotated in the clockwise direction, the stopper piece 31 moves upward to the uppermost end of the opening 35*a* and then rotates in the counter clockwise direction to return to the initial position.

Figure 6:
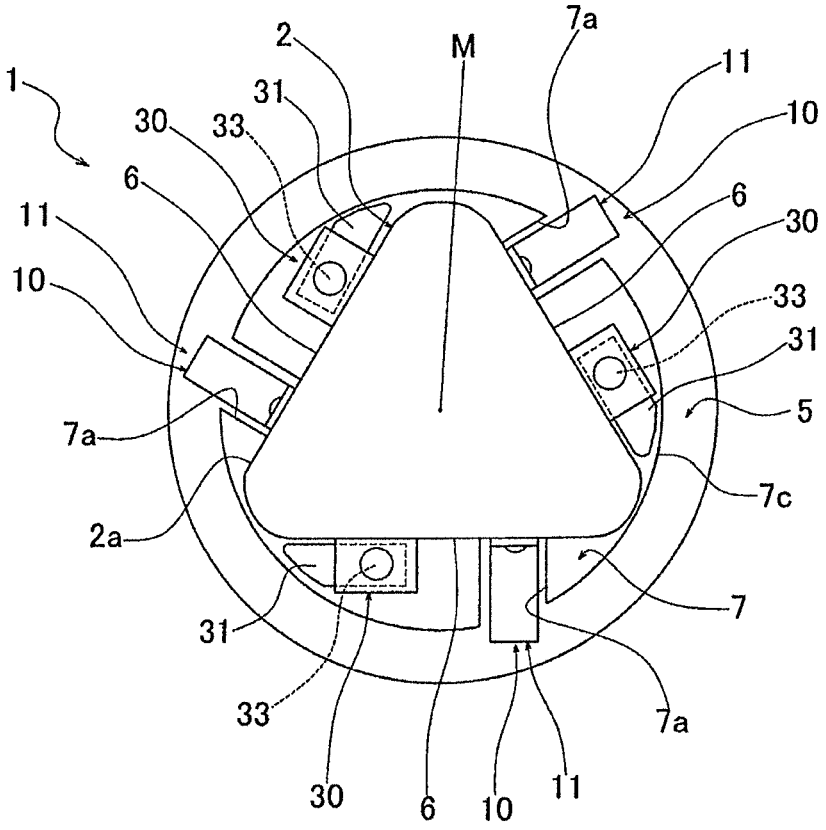
FIG. 6 is a schematic plan view of the speaker unit, which is explanatory of positional arrangements of a provisionally fastening mechanism and the stopper mechanism.

FIG. 6 is a schematic plan view of the speaker unit 1, which is explanatory of positional arrangements of the provisionally fastening mechanism 10 and the stopper mechanism 30. As viewed in plan, the cabinet section 2 of the speaker unit 1 has a shape (generally triangular cylindrical shape) of which the outer peripheral side surface 2*c* comprises three flat outer peripheral surfaces 6 that are oriented in three different directions at equal angular intervals about the center axis M of the cylindrical cabinet section 2. Further, a set of the provisionally fastening mechanism 10 and the stopper mechanism 30 is provided on each individual one of the flat outer peripheral surfaces 6 (within the range of each individual one of the flat outer peripheral surfaces 6) constituting the outer peripheral side surface 2*c* of the cabinet section 2; thus, in this case, three sets of the provisionally fastening mechanisms 10 and the stopper mechanisms 30 are provided on the flat outer peripheral surfaces 6 oriented in three equally angularly spaced directions (i.e., at equal angular intervals along the outer peripheral side surface 2*c* of the speaker unit 1) and constituting the outer peripheral side surface 2*c* of the cabinet section 2. Namely, the speaker unit 1 is provided with a total of three sets of the provisionally fastening mechanisms 10 and the stopper mechanisms 30 on the flat outer peripheral surfaces 6 oriented at equal angular intervals about the center axis M of the of the cylindrical cabinet section 2.

Note that the respective provisionally fastening tabs 11 of the provisionally fastening mechanisms 10 have the same shape and are located at the same height position. Similarly, the stopper mechanisms 30 have the same construction and are located at the same height position. Further, an upper-limit position of the stopper piece 31 of each of the stopper mechanisms 30 is set higher than the height position of the engaging section 13 of the provisionally fastening tab 11.

Figure 7A:
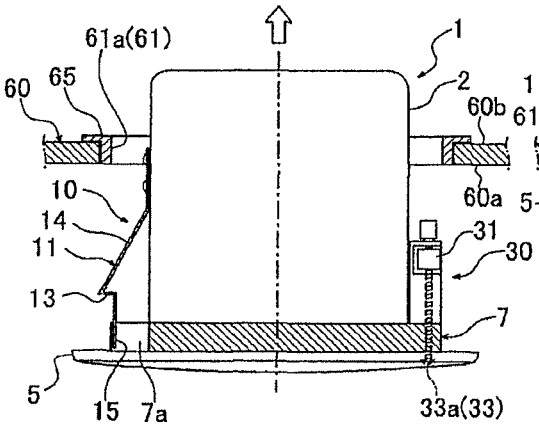
FIGS. 7A to 7D are views explanatory of an operational sequence for mounting the speaker unit in the mounting hole of the ceiling.
Figure 7B:
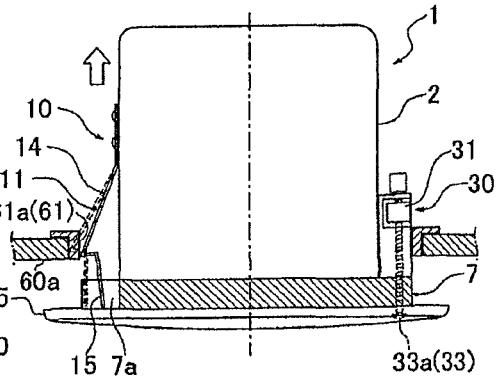

The following describe, with reference to FIGS. 7A to 7D, an operational sequence for installing or mounting the speaker unit 1 of the aforementioned construction in the mounting hole 61 of the ceiling 60. For the mounting of the speaker unit 1 in the ceiling 60, the mounting hardware member 65 is installed in advance on the inner peripheral edge portion 61*a* of the mounting hole 61 of the ceiling 60 as shown in FIG. 7A, and the stopper piece 31 is placed in advance in the aforementioned initial position. In such a state, the cabinet section 2 of the speaker unit 1 is inserted into the mounting hole 61 from the face side of the ceiling 60 and then pushed upward through the mounting hole 61.

Figure 7C:
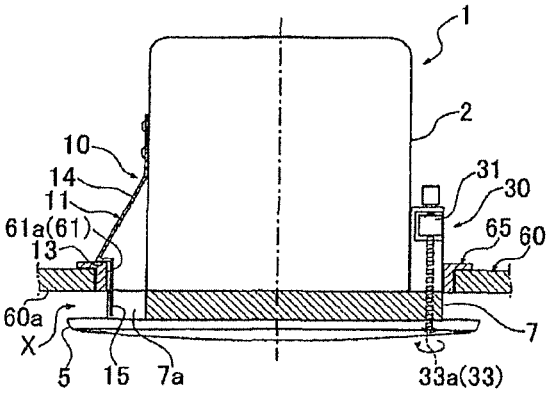

As the cabinet section 2 moves upward through the mounting hole 61 as above, the inner peripheral edge portion 61*a* of the mounting hole 61 abuts against the slanting section 14 of each of the provisionally fastening tabs 11. Then, as the speaker unit 11 is pushed further upward, each of the slanting sections 14 pressed by the inner peripheral edge portion 61*a* of the mounting hole 61 resiliently deforms radially inward, so that the slanting section 14 and the engaging section 13 get over the inner peripheral edge portion 61*a* of the mounting hole 61 to shift to the reverse side 60*b* of the ceiling 60. Once the slanting sections 14 and the engaging sections 13 get over the inner peripheral edge portion 61*a* of the mounting hole 61 in the aforementioned manner, the provisionally fastening tabs 11 resiliently deform back (revert) to the original shape, so that the engaging sections 13 are brought to engagement with the inner peripheral edge portion 61*a* of the mounting hole 61 as shown in FIG. 7C. In this manner, the speaker unit 1 is provisionally mounted in the mounting hole 61. Thus, the speaker unit 1 can be retained so as not to fall down from the mounting hole 61, even without the human operator supporting the speaker unit 1. Note that, according to the instant embodiment, the speaker unit 1 includes the aforementioned provisionally fastening tabs 11 provided on three positions of the outer peripheral side surface 2*c* of the cabinet section 2. In this way, the speaker unit 1 is provisionally fastened uniformly at the three positions of the outer peripheral side surface 2*c* of the cabinet section 2 by means of the three provisionally fastening tabs 11.

Figure 7D:
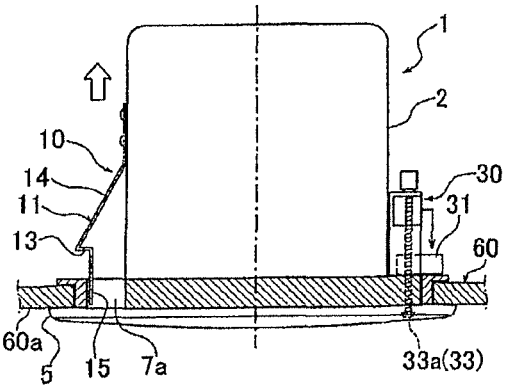

After being placed in the provisionally fastened state in the aforementioned manner, the speaker unit 1 is fully fastened by means of the stopper mechanisms 30 as follows. Namely, by the human operator rotating, from the side of the bottom surface 2*a* (face side) of the speaker unit 1, the head portions 33*a* of the screw shafts 33 by means of a tool, such as a screw driver, the corresponding stopper pieces 31 in the initial position are rotated and moved downward toward the bottom cover 7. Thus, the lower surfaces 31*b* of the stopper pieces 31 come to abut against the inner peripheral edge portion 61*a* of the mounting hole 61 (reverse side surface 60*b* of the ceiling 60). Then, as the screw shafts 33 are further rotated, the stopper pieces 31 are moved further downward relative to the screw shafts 33. Because the ceiling 60 is invariable in position (i.e., vertical position), the reverse side surface 60*b* of the ceiling 60 is pressed by the stopper pieces 31 so that the speaker unit 1 is pushed upward. In this manner, the speaker unit 1 gradually moves upward through the mounting hole 61. Then, as shown in FIG. 7D, the inner peripheral edge portion 61*a* of the mounting hole 61 is sandwiched between the stopper pieces 61 and the flange portions 5 by the flange portions 5 abutting against the face side surface 60*a* of the ceiling 60. In this way, the speaker unit 1 is ultimately fully fixed or fastened to the ceiling 60 through the mounting hole 61.

In order to cancel the provisionally fastened state (i.e., state shown in FIG. 7C) of the speaker unit 1 and pull the speaker unit 1 out of the mounting hole 61, the human operator inserts a finger of its (his or her) hand in the gap X between the face side surface 60*a* of the ceiling 60 and the flange portion 5 and presses the operating section 5 of each of the provisionally fastening tabs 11 with the inserted finger. Thus, each of the provisionally fastening tabs 11 resiliently deforms radially inwardly, so that the engaging section 13 is released from the engagement with the inner peripheral edge portion 61*a* of the mounting hole 61 and thus the provisionally fastened state of the speaker unit 1 is canceled. Then, the human operator can pull the speaker unit 1 out of the mounting hole 61 by lowering the speaker unit 1 while supporting the speaker unit 1 with its (his or her) hand. At that time, the human operator can press the operating section 15 of each of the provisionally fastening tabs 11 by inserting a finger of its hand while supporting the bottom surface 2*a* of the cabinet section 2 with the palm of the hand. Because the human operator can cancel the engagement of each of the provisionally fastening tabs 11 while reliably supporting the heavy speaker unit 1 with the palm of the hand, the provisional fastening of the speaker unit 1 can be effected safely and promptly.

Figure 8A:
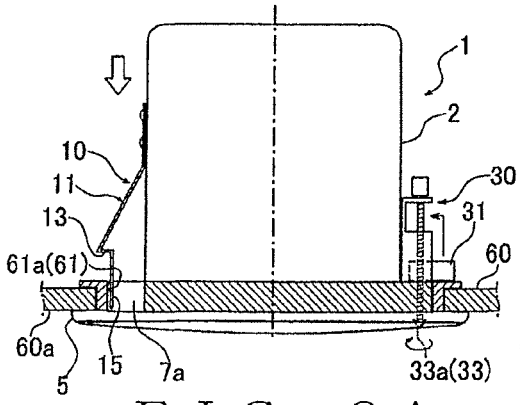
FIGS. 8A to 8D are views explanatory of an operational sequence for dismounting the speaker unit mounted in the mounting hole of the ceiling.
Figure 8B:
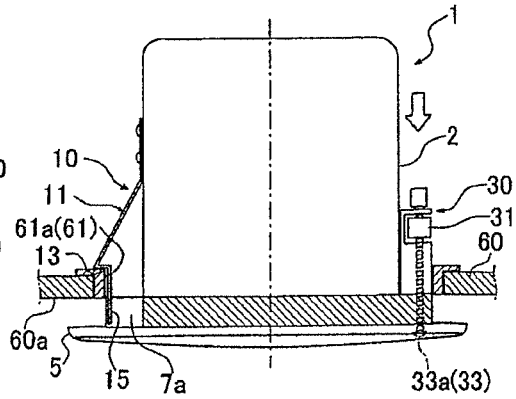
Figure 8C:
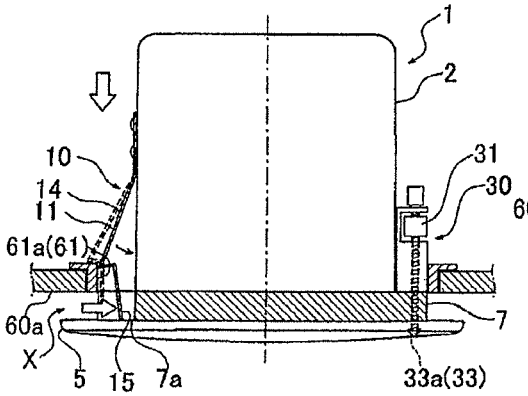

The following describe, with reference to FIGS. 8A to 8D, an operational sequence for dismounting the speaker unit 1 mounted in the mounting hole 61 of the ceiling 60. For the dismounting of the speaker unit 1 mounted in the mounting hole 61, each of the screw shafts 33 is rotated in the clockwise direction with the stopper piece 31 held in the fixed position, as shown in FIG. 8A. Thus, the stopper piece 31 moves upward, so that the sandwiching of the inner peripheral edge portion 61*a* of the mounting hole 61 by the stopper piece 31 and the flange portion 5 is released. Then, as the screw shaft 33 is further rotated in the clockwise direction, the stopper piece 31 is moved further upward, so that the speaker unit 1 gradually moves downward through the mounting hole 61. Then, the downward movement of the speaker unit 1 stops by the engaging section 13 of the provisionally fastening tab 11 abutting against the reverse side surface 60*b* of the ceiling 60 (inner peripheral edge portion 61*a* of the mounting hole 61). Thus, the speaker unit 1 is placed in the provisionally fastened state by the provisionally fastening mechanism 10. Then, as the screw shaft 33 is rotated further in the clockwise direction, the stopper piece 31 moves upward to the upper-limit position in the opening 35*a* and turns 90° to return to the initial position.

Figure 8D:
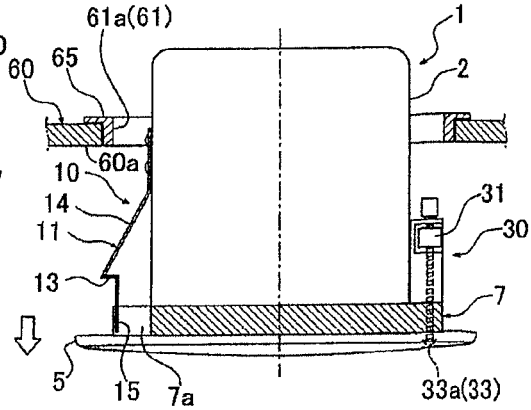

Then, with the speaker unit 1 in the provisionally fastened state, the human operator inserts a finger of its hand in the gap X between the face side surface 60*a* of the ceiling 60 and the flange portion 5 and presses the operating section 5 of each of the provisionally fastening tabs 11. In this manner, the engagement of the engaging section 13 with the inner peripheral edge portion 61*a* of the mounting hole 61 is canceled, so that the provisional fastening is canceled. At that time too, the human operator can press the operating section 15 of the provisionally fastening tab 11 by inserting a finger of its hand while supporting the bottom surface 2*a* of the cabinet section 2 with the palm of the hand. Then, the human operator pulls the speaker unit 1 out of the mounting hole 61 by gradually lowering the speaker unit 1 while supporting the speaker unit 1 with the palm of the hand, as shown in FIG. 8D. In this way, the speaker unit 1 can be dismounted from the mounting hole 61.

As noted above, each of the provisionally fastening mechanisms 10 provided in the speaker unit 1 includes the provisionally fastening tab 11 having the engaging section 13 engageable with the inner peripheral edge portion 61*a* of the mounting hole 61. In the provisionally fastened state where the engaging section 13 of the provisionally fastening tab 11 is retained in engagement with the inner peripheral edge portion 61*a* of the mounting hole 61, the human operator can press, from the face side of the ceiling 60, the operating section 15 of the provisionally fastening tab 11 exposed to the gap X between the mounting hole 61 and the cabinet section 2 (flange portion 5); namely, by pressing the provisionally fastening tab 11 to resiliently deform the tab 11, the human operator can release the engaging section 13 from the engagement with the inner peripheral edge portion 61*a* of the mounting hole 61.

Thus, by the human operator merely pressing, from the face side of the ceiling 60, the provisionally fastening tab 11 to thereby resiliently deform the tab 11, the provisional fastening, by the provisionally fastening mechanism 10, of the speaker unit 1 can be readily canceled. Thus, in the speaker unit mounting or dismounting operation, the provisional fastening of the speaker unit 1 can be readily canceled through a simple manual operation performed from the face side with the speaker unit 1 provisionally fastened by the provisionally fastening tab 11. Therefore, the instant embodiment can enhance operability when the provisionally fastened speaker unit is to be dismounted for some reason in the speaker unit mounting operation, or when the speaker unit placed in the provisionally fastened state after having been released from the fully fixed or fastened state is to be pulled out of the mounting hole 61 in the speaker unit dismounting operation.

Further, according to the instant embodiment of the mounting structure, the gap X of a size permitting insertion therein of a finger of a human operator's hand is formed between the face side surface 60*a* of the ceiling 60 and the flange portion 5 of the speaker unit 1, and the operating section 15 of the provisionally fastening tab 11 can be depressed or operated with the inserted finger. Thus, the human operator can cancel the provisional fastening, by the tab 11, of the speaker unit 1, with a simple construction and through only a simple operation.

Further, with the provisionally fastening mechanism 10 in the instant embodiment, the provisionally fastening tab 11, which is in the form of a thin, resilient metal plate and integrally having the mounting section 12, slanting section 14, engaging section 13 and operating section 15, can be resiliently deformed radially inward, by the human operator depressing, from the face side of the ceiling 60, the operating section 15 deeper into the hollow portion 7*a* with the engaging section 13 held in engagement with the inner peripheral edge portion 61*a* of the mounting hole 61. In this way, the engaging section 13 can be readily released from the engagement with the inner peripheral edge portion 61*a* of the mounting hole 61. Thus, even though the provisionally fastening mechanism 10 is of a simple construction comprising a minimized number of necessary component part, i.e. comprising only the provisionally fastening tab 11 constructed in the aforementioned manner, the provisional fastening of the speaker unit 1 can be canceled with only a simple manual pressing operation performed from the face side of the ceiling 60.

Further, as noted above, the provisionally fastening tab 11 has the slanting section 14 obliquely extending from the mounting section 12 toward the radially outward end of the cabinet section 2 and toward the bottom surface 2*a*. Thus, as the cabinet section 2 is inserted through the mounting hole 61, the sliding section abuttingly slides across the inner peripheral edge portion 61*a* of the mounting hole 61 until the engaging section 13 gets over the inner peripheral edge portion 61*a* and comes into engagement with the inner peripheral edge portion 61*a*. In this way, the instant embodiment permits the provisional fastening of the speaker unit 1 with only the simple operation of inserting the cabinet section 2 through the mounting hole 61 and without requiring any tool and the like.

Further, with the instant embodiment, where the hollow portion 7*a* for positioning therein the operating section 15 of the provisionally fastening tab 11 is formed in the bottom cover 7, the operating section 15 of the provisionally fastening tab 11 can be exposed, through the hollow portion 7*a*, to the gap X between the face side surface 60*a* of the ceiling 60 and the flange portion 5. Thus, in the provisionally fastened state, the operation for pressing the provisionally fastening tab 11 can be performed reliably from the face side of the ceiling 60 through the gap X. Besides, because the provision of the hollow portion 7*a* can secure a movable space for the provisionally fastening tab 11, the engaging section 13 can be reliably released from the engagement with the inner peripheral edge portion 61*a* of the mounting hole 61 by the provisionally fastening tab 11 being merely pressed from the face side of the ceiling 60.

Further, in the instant embodiment, one provisionally fastening mechanism 10 and one stopper mechanism 30 are disposed on each of the flat outer peripheral surfaces 6 (i.e., within the range of the flat outer peripheral surface 6) of the outer peripheral side surface 2*c* of the cabinet section 2. More specifically, one provisionally fastening mechanism 1 and one stopper mechanism 30 are disposed on one flat outer peripheral surface 6 that is oriented in one direction on the outer peripheral side surface 2*c*, and thus, a provisionally fastened position provided by the one provisionally fastening mechanism 10 and a fully fastened position provided by the one stopper mechanism 30 are located along the same radial direction or on the same radial side. Thus, the speaker unit 1 provisionally fastened by the provisionally fastening mechanism 10 can be fully fastened by the stopper mechanism 30 in stable condition. Further, because the provisionally fastening mechanism 10 and the stopper mechanism 30 are disposed on the same flat surface 6 (i.e., within the range of the flat outer peripheral surface 6), the operation for mounting the speaker unit can be performed with an increased efficiency.

Further, in the instant embodiment, a plurality of sets of the provisionally fastening mechanisms 10 and the stopper mechanisms 30 are provided at equal angular intervals along the outer periphery of the speaker unit 1. Thus, the provisional fastening and the full fastening of the speaker unit 1 is performed at a plurality of positions located along the outer periphery of the speaker unit 1. In this way, the instant embodiment permits stabilization of the provisional fastening and the full fastening of the speaker unit 1.

It should be appreciated that the present invention is not limited to the above-described preferred embodiment and can be modified variously within the scope of appended claims and within the scope of the technical idea disclosed in the claims and drawings. For example, whereas the preferred embodiment has been described in relation to the case where it mounts the speaker unit 1 in the mounting hole 61 of the ceiling 60, it may mount the speaker unit 1 by embedding the speaker unit 1 in a mounting hole provided in any other desired mounting part than the ceiling 60, such as a side wall or slanting wall.

Further, the material, shape, dimensions, etc, of the provisionally fastening tab 11 employed in the above-described preferred embodiment are merely illustrative, and the provisionally fastening member 11 in the present invention may be of any other suitable material, shape, dimensions etc. than those described above in relation to the preferred embodiment. For example, the provisionally fastening member 11 may be formed of any other suitable material than the aforementioned resilient metal material as long as the material is a resilient material; as an example, the provisionally fastening member 11 may be formed as a molding of any of various synthetic resin materials (such as plastics, ABS resin and acryl resin) and rubber materials. Further, the provisionally fastening member 11 may be of any other desired shape than the thin plate shape, such as a bar shape. Furthermore, the provisionally fastening member 11 in the present invention need not necessarily be a single integrally-formed component part as long as it includes sections corresponding to the aforementioned engaging section and the operating section. Alternatively, the various sections, such as the engaging section, operating section and slanting section, may be mutually separate sections rather than integrally-formed sections. As another alternative, the provisionally fastening member 11 may be constructed in such a manner that, in response to an operation performed on the operating section, any of the sections separate or disengage from each other to cancel the provisional fastening. Further, in the case where the provisionally fastening member 11 is constructed as a single integrally-formed component part, it is not necessarily constructed to be resiliently deformable in its entirety, and only a part thereof may be constructed to be resiliently deformable to move the engaging section into and out of the engagement with the inner peripheral edge portion 61*a* of the mounting hole 61.

Further, the operating section 15 of the provisionally fastening member 11 is not necessarily limited to the above-described construction suited for a depressing operation and may be constructed to be suited for any other desired form of operation, such as an operation of pulling out the operating section 15 toward the human operator or an operation of moving the operating section 15 in a lateral direction.

Further, the hollow portion 7*a* of the bottom cover 7, in which the operating section 15 of the provisionally fastening tab 11 is positioned, is not necessarily be limited to the aforementioned rectangular hollow (cavity) and may be of any other suitable shape and dimensions (particularly, width dimension) as long as the human operator can insert its finger. Thus, the provisionally fastening tab 11 may be formed in any desired shape and dimensions, for example, by recessing (removing) a greater range of the bottom cover 7 at and around a particular portion of the bottom cover 7 corresponding to the operating section 15 of the provisionally fastening tab 11.

Furthermore, the specific shape of the speaker unit 1 shown and described in relation to the above-described preferred embodiment is merely illustrative, and the various sections of the speaker unit 1 may be formed in any other suitable shapes than those shown and described in relation to the above-described preferred embodiment. For example, the cabinet section 2 may be of any other suitable shape than a substantially triangular shape as viewed in the axial direction thereof (see FIG. 6), such as a substantially circular shape. Namely, the cabinet section 2 may be formed in a generally circular cylindrical shape. In such a case, the provisionally fastening tab 11 and the stopper mechanisms 30 need not necessarily be provided directly on the outer peripheral side surface 2*c* of the cylindrical cabinet section 2 and may be provided on a flat inner bottom surface (inner side surface) of a rectangular recessed portion formed in the outer peripheral side surface 2*c*.

While it is preferred that the speaker unit 1 provides with a plurality of the provisionally fastening mechanisms 10 in view of safety of provisionally fastening, as understood apparently from the above description, the speaker unit 1 may provide with at least one provisionally fastening mechanisms 10. Namely, if the speaker unit 1 provides with at least one provisionally fastening mechanisms 10, it can be achieved to provisionally fasten the speaker unit 1 and release it from the provisionally fastened state with a simple construction of a minimized number of necessary component parts and through only a simple operation performed from the face side of the mounting part 60.

Furthermore, the speaker unit 1 described above in relation to the preferred embodiment is of a type that has various component parts, such as a screw driver, incorporated therein in advance. However, the speaker unit 1 to be mounted to a mounting part, such as a ceiling or wall, by use of the mounting structure of the present invention may be of a type that does not have all of the various component parts incorporated therein or does not have any one of the various component parts incorporated therein. Namely, first a speaker unit including only the cabinet section may be mounted to an opening section of a ceiling or the like by use of the mounting structure of the present invention, and then necessary component parts may be accommodated in the cabinet section.

This application is based on, and claims priority to, Japanese Patent Application No. 2012-132404 filed on 11 Jun. 2012. The disclosure of the priority application, in its entirety, including the drawings, claims, and the specification thereof, are incorporated herein by reference.

What is claimed is:

1. A speaker unit adapted to be mounted in an opening section formed in a mounting part, the speaker unit comprising:

a cabinet section having an outer peripheral side surface and a bottom surface;

a speaker face provided on the bottom surface of the cabinet section; and a provisionally fastening mechanism provided on the outer peripheral side surface of the cabinet section and adapted to provisionally fasten the speaker unit with at least a part of the cabinet section inserted in the opening section from a face side of the mounting part without a human operator manually supporting the speaker unit, said provisionally fastening mechanism comprising:

an engaging section adapted to make the speaker unit provisionally engage the mounting part; and an operating section exposed to the face side of the mounting part with the speaker unit engaged the mounting part via the engaging section, said operating section adapted to cancel engagement between the speaker unit and the mounting part via said engaging section in response to an operation of a portion of the operating section where the operating section is exposed.

2. A speaker unit mounting structure for mounting a speaker unit in an opening section formed in a mounting part, the speaker unit including a cabinet section having an outer peripheral side surface and a bottom surface, and a speaker face provided on the bottom surface of the cabinet section, said speaker unit mounting structure comprising a provisionally fastening mechanism constructed to provisionally fasten the speaker unit with at least a part of the cabinet section inserted in the opening section from a face side of the mounting part without a human operator manually supporting the speaker unit, said provisionally fastening mechanism including a provisionally fastening member formed of a resilient material and mounted to the outer peripheral side surface of the cabinet section, said provisionally fastening member including:

an engaging section engageable with an inner peripheral edge portion of the opening section on a reverse side of the mounting part to thereby place the speaker unit in a provisionally fastened state; and an operating section exposed to the face side of the mounting part through a gap between the opening section and the cabinet section, wherein, in response to said operating section being operated from the face side of the mounting part, said provisionally fastening member resiliently deforms so that engagement of said engaging section with the inner peripheral edge portion of the opening section is canceled.

3. The speaker unit mounting structure as claimed in claim 2, which further comprises a flange portion projecting radially outward from an outer peripheral edge of the bottom surface of the cabinet section, and wherein, with the speaker unit in the in the provisionally fastened state, the gap is defined between a face side surface of the mounting part and said flange portion, and in response to said operating section being operated with a finger through the gap, engagement of said engaging section with the inner peripheral edge portion of the opening section is canceled.

4. The speaker unit mounting structure as claimed in claim 2, wherein said provisionally fastening member integrally has: a mounting section fixed to the outer peripheral side surface of the cabinet section; a slanting section extending obliquely downward from the mounting section toward a radially outward end of the cabinet section and toward the bottom surface; the engaging section extending radially inward from a distal end of said slanting section; and said operating section extending from a distal end of said engaging section toward the bottom surface of the cabinet section.

5. The speaker unit mounting structure as claimed in claim 2, wherein said provisionally fastening member is constructed in such a manner that the engagement of said engaging section with the inner peripheral edge portion of the opening section is canceled in response to said operating section being pressed, and said operating section is disposed with an interval from the outer peripheral side surface of the cabinet section.

6. The speaker unit mounting structure as claimed in claim 5, which further comprises a bottom cover that surrounds the bottom surface of the cabinet section and an outer periphery of the cabinet section adjoining the bottom surface and that has an outer peripheral edge disposed along the inner peripheral edge portion of the opening section, and said bottom cover has a hollow portion formed therein with the interval left between the operating section and the inner surface of the hollow portion.

7. The speaker unit mounting structure as claimed in claim 2, which further comprises a fixation mechanism for fully fastening the speaker unit provisionally fastened in the opening section by said provisionally fastening mechanism, and said fixation mechanism includes a fixation member provided for movement alongside of the cabinet section and constructed to sandwich the inner peripheral edge portion of the opening section between the flange portion and the fixation member to thereby fix the speaker unit.

8. The speaker unit mounting structure as claimed in claim 7, wherein the outer peripheral side surface of the cabinet section comprises a plurality of flat surfaces, and at least a set of the provisionally fastening mechanism and the fixation mechanism is disposed in association with each individual one of the plurality of flat surfaces of the outer peripheral side surface.

9. The speaker unit mounting structure as claimed in claim 7, wherein the speaker unit includes a plurality of sets of the provisionally fastening mechanisms and the fixation mechanisms.

* * * * *